US009499771B2

(12) United States Patent
Partain, III et al.

(10) Patent No.: US 9,499,771 B2
(45) Date of Patent: Nov. 22, 2016

(54) FABRIC AND SURFACE CARE FORMULATIONS CONTAINING TERTIARY AMINO MODIFIED CELLULOSE DERIVATIVES

(71) Applicants: Union Carbide Chemicals & Plastics Technology LLC, Midland, MI (US); Rohm and Haas Company, Philadelphia, PA (US)

(72) Inventors: Emmett M. Partain, III, Bound Brook, NJ (US); Jan E. Shulman, Newtown, PA (US); Josephine Eldredge, Norristown, PA (US)

(73) Assignees: Union Carbide Chemicals & Plastics Technology LLC; Rohm and Haas Company

( * ) Notice: Subject to any disclaimer, the term of this patent is extended or adjusted under 35 U.S.C. 154(b) by 0 days.

(21) Appl. No.: 14/424,070

(22) PCT Filed: Sep. 25, 2013

(86) PCT No.: PCT/US2013/061590

§ 371 (c)(1),
(2) Date: Feb. 26, 2015

(87) PCT Pub. No.: WO2014/052396

PCT Pub. Date: Apr. 3, 2014

(65) Prior Publication Data

US 2015/0299619 A1 Oct. 22, 2015

Related U.S. Application Data

(60) Provisional application No. 61/707,306, filed on Sep. 28, 2012.

(51) Int. Cl.
*C11D 1/00* (2006.01)
*C11D 3/22* (2006.01)

(52) U.S. Cl.
CPC ..... *C11D 3/227* (2013.01)

(58) Field of Classification Search
CPC ..... C11D 1/00; C11D 3/22; C11D 3/227
See application file for complete search history.

(56) References Cited

U.S. PATENT DOCUMENTS

| | | | | |
|---|---|---|---|---|
| 4,011,169 | A | 3/1977 | Diehl et al. | |
| 8,518,387 | B2 * | 8/2013 | Drovetskaya | A61K 8/731 424/70.13 |
| 2009/0318326 | A1 * | 12/2009 | Lant | C11D 3/225 510/320 |
| 2011/0142779 | A1 * | 6/2011 | Drovetskaya | A61K 8/731 424/70.13 |

FOREIGN PATENT DOCUMENTS

| | | |
|---|---|---|
| WO | 2010/111576 A2 | 9/2010 |

* cited by examiner

*Primary Examiner* — Brian P Mruk

(57) ABSTRACT

Described are fabric and surface care compositions comprising a tertiary amine substituted cellulose derivative and at least one surfactant.

12 Claims, No Drawings

FABRIC AND SURFACE CARE FORMULATIONS CONTAINING TERTIARY AMINO MODIFIED CELLULOSE DERIVATIVES

CROSS REFERENCE TO RELATED APPLICATIONS

This application is a 35 USC §371 national phase filing of PCT/US2013/061590 filed Sep. 25, 2013, which claims priority from U.S. provisional application Ser. No. 61/707,306, filed Sep. 28, 2012, which is incorporated herein by reference in its entirety.

FIELD

The present application relates to fabric and surface care compositions, including laundry and dishwashing compositions.

BACKGROUND

Polyquaterniums such as PQ-10, PQ-24 and PQ-67 are quarternized cellulose derivatives. The positive charge of a quarternized cellulose derivative is beneficial in laundry, as it deposits on anionic cotton, providing softening, improved deposition, sizing, or other conventional benefits. Similarly, quarternized cellulose derivatives are beneficial in dish care, providing skin benefits, foam enhancement, or other conventional benefits. However, polyquaterniums can have some drawbacks. For example, a normal by-product from the manufacture and storage of polyquaternium-10 is trimethylamine, which has an undesirable odor that should be masked, which may not always be possible, for example, in fragrance-free formulations.

Heretofore, tertiary amines have not been used in fabric and surface care compositions because it was believed that polyquaterniums were superior because they are permanently charged, independent of the pH of their solution.

Given the focus in the art toward developing new agents with desirable attributes, even modest improvements in performance or desirable traits are of importance.

DETAILED DESCRIPTION

In one embodiment, the present invention provides fabric and surface care compositions, comprising a tertiary amine substituted cellulose derivative and a least one surfactant.

It is understood that cellulose is a linear, unbranched polysaccharide composed of anhydroglucose monosaccharide units linked through their 1,4 positions by the 13 anomeric configuration. Substitution of the hydroxyl groups (with positions at 2, 3, or 6) will yield cellulose derivatives. Common substitutions include methyl (methylcellulose), ethyl (ethylcellulose), ethoxy (hydroxyethylcellulose), isopropyloxy (hydroxypropylcellulose), and mixtures thereof, such as hydroxypropyl methylcellulose. The theoretical limit of hydroxyl substitution is three. As not every anhydroglucose unit will be substituted identically, the average number of hydroxyl groups substituted per anhydroglucose unit is referred to as the degree of substitution, i.e., as a mean over the whole polymer chain.

Terminal hydroxyl groups of substituents may further be substituted with a quaternary amine (for example, by alkylating hydroxyethyl cellulose with either glycidyl trimethylammonium chloride or 3-chloro-2-hydroxypropyltrimethylammonium chloride) to form permanently cationic cellulose derivatives (including polyquaterniums, PQ-10, PQ-24, and PQ-67). In contrast, tertiary amine substituted cellulose derivative is not permanently charged; i.e., the charge on the tertiary amine is pH dependent. In one embodiment, tertiary amine substituted cellulose derivative is prepared by adding N,N-diethylaminoethyl chloride hydrochloride to hydroxyethylcellulose, although other cellulose derivatives are contemplated as well.

In one embodiment, the present invention provides a tertiary amine substituted cellulose derivative having a Formula (I):

(I)

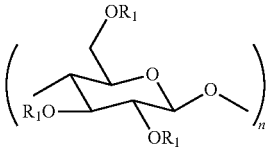

wherein n is an integer sufficient to produce a polymer with a weight-average molecular weight (Mw) in the range of about 50,000 to 2,000,000;

$R_1$ is, independently at each occurrence, H, —$CH_3$, or —$CH_2CH_2O$—$R_2$; and $R_2$ is, independently at each occurrence, H, $CH_3$, or $R_3N(R_4)_2$ or it salt wherein:

$R_3$ is $C_{1-6}$ alkylene;

$R_4$ is, independently at each occurrence, $C_{1-6}$ alkyl, or both $R_4$ groups may form, along with the nitrogen to which they are attached, a saturated or unsaturated 5 or 6 member heterocyclic ring, provided that at least one $R_1$ in the polymer contains an $R_3N(R_4)_2$ group.

The term "alkylene" refers to a diradical alkyl group, a non-limiting example being ethylene. "Heterocyclic" refers to a ring containing the indicated number of carbon atoms and at least one heteroatom selected from N and O, and wherein the ring is saturated or unsaturated, but not aromatic. Non-limiting examples include morpholinyl, piperidinyl, and pyrrolidinyl.

Unless specified otherwise, all radicals include optionally substituted embodiments. "Optionally substituted" refers to hydroxyl, alkoxy, carboxy, nitro, amino, amido, halo, or $C_{1-3}$ alkyl.

Unless otherwise indicated, numeric ranges, for instance as in "from 2 to 10," are inclusive of the numbers defining the range (e.g., 2 and 10).

Accordingly, for example, Formula I specifically contemplates $R_3$ ($C_{1-6}$ alkylene) as —$CH_2CH(OH)CH_2$— and —$CH_2CH(OH)$—. The $R_3$ portion of Formula I is generally considered a bridge or tether to connect the remainder of the tertiary amine ($N(R_4)_2$ or its salt (e.g., $N^+(R_4)_2H$) to the cellulose ether. Examples of $R_3$ include —$CH_2$—, —$CH_2CH_2$—, and —$CH_2$—$CH(CH_3)$—.

In a preferred embodiment, $R_1$ is H or —$CH_2CH_2O$—$R_2$. A preferred cellulose derivative is hydroxyethylcellulose.

In a preferred embodiment, $R_3$ is —$CH_2CH_2$— or —$CH_2CH(OH)CH_2$—.

In a preferred embodiment, $R_4$ is, independently, $CH_3$ or $CH_2CH_3$.

In one embodiment, the Kjeldahl nitrogen content is from about 0.02% to about 7.5%, preferably about 0.1% to about 5%, most preferably from about 0.2% to about 3%.

In one embodiment, the substituted cellulose derivative of formula I has a degree of substitution ("DS") of at least 0.1, alternatively at least 0.3. In some embodiments, the degree of substitution is less than 1, alternatively, 0.6 or less, or alternatively 0.4 or less. In some embodiments, the degree of substitution is from 0.1 to 0.4. In this specification, DS refers to the number of moles of $R_3N(R_4)_2$ groups per mole of anhydroglucose repeat units in the polymer backbone. A DS of 1 indicates that (on average) each repeating anhydroglucose unit has one $R_3N(R_4)_2$ group substituent. The DS is determined from the Kjeldahl nitrogen analysis. The DS measurement is not predictive of where in the polymer backbone the substitution is occurring.

In some embodiments, the substituted cellulose derivative of formula I has a weight-average molecular weight (Mw) in the range of at least 300,000 Daltons, alternatively at least 400,000, alternatively at least 1,000,000, or alternatively at least 1,500,000. In some embodiments, the weight-average molecular weight is from about 1,500,000 to about 2,000,000. In some embodiments, the weight-average molecular weight is about 1,600,000.

Non-limiting examples of the hydroxyethylcellulose embodiment of the present invention include N,N-diethylaminoethyl hydroxyethylcellulose, N,N-dimethylaminoethyl hydroxyethylcellulose, N,N-diisopropylaminoethyl hydroxyethylcellulose, N,N-dimethylaminopropyl hydroxyethylcellulose, N-ethyl piperidine hydroxyethylcellulose, N-ethyl morpholine hydroxyethylcellulose, and N-ethyl pyrrolidine hydroxyethylcellulose.

The surfactant may be a cationic, anionic, nonionic, or amphoteric surfactant, or a mixture thereof. In one embodiment, the surfactant is linear alkyl benzene sulfonate. In one embodiment, the surfactant is sodium alcohol ethoxylate sulfate. In one embodiment, the surfactant is a mixture of linear alkyl benzene sulfonate and sodium alcohol ethoxylate sulfate. In one embodiment, the surfactant is a nonionic surfactant, such as an alcohol ethoxylate.

Compositions of the inventions may contain various optional ingredients known to those skilled in art including, without limitation, solvents (e.g., ethanol), builders, chelants, surfactants, hydrotropes, co-solvents, adjuvants, fillers (e.g., inorganic fillers), soda ash, bleach, bleach activator, and the like.

In one embodiment, the fabric and surface care composition is a liquid. In a preferred embodiment, fabric and surface care composition further comprise ethanol and/or propylene glycol. In one embodiment, the fabric and surface care composition further comprises Sodium Xylene Sulfonate.

In a preferred embodiment, the fabric and surface care composition is a powder laundry detergent, powder laundry detergent, cleaning solution, or dishwashing formulation. In use, the fabric and surface care compositions are applied to textiles or hard surfaces, including dishes.

In one embodiment, the fabric and surface care composition is a laundry detergent with "reduced odor," defined as reduced odor detected by trained panelists as compared to similar formulations where tertiary amine substituted cellulose derivative is replaced with a quarternized cellulose derivative.

In one embodiment, the fabric and surface care composition is a laundry fragrance enhancer. Further optional additives that may be included in a laundry fragrance enhancer formulation include, for instance, one or more of a polyethylene glycol, starch, or clay.

In one embodiment, the fabric and surface care composition is a hand dishwashing detergent with "improved skin feel," defined as rated as having superior aesthetics by trained panelists as compared to similar formulations where tertiary amine substituted cellulose derivative is replaced with a quarternized cellulose derivative.

A person of ordinary skill in the art can readily determine, without undue experimentation, the relative amounts of the tertiary amine substituted cellulose derivative of formula I and the surfactant that should be present in any particular formulation. By way of example, suitable formulations may contain from 0.05 to 2.0 percent by weight of the tertiary amine substituted cellulose derivative based on the total weight of the tertiary amine substituted cellulose derivative and the surfactant.

The following examples are for illustrative purposes only and are not intended to limit the scope of the present invention. All percentages are by weight unless otherwise specified.

SYNTHESIS EXAMPLES

Tertiary amino-modified cellulose derivatives are prepared using the following general procedure. The starting materials used are commercial CELLOSIZE hydroxyethyl cellulose (HEC) products of low, intermediate, and high molecular weight designated CELLOSIZE HEC A, B, and C, respectively. The weight-average molecular weights (Mw) of these commercial CELLOSIZE HEC products are shown in Table 1, and were determined using size-exclusion chromatography and a low-angle laser light scattering detector.

Example 1

A 500 ml, four-necked, round-bottomed flask is charged with 28.36 g (25.00 g contained) of CELLOSIZE HEC A, 5.44 g of 2-chloro-N,N-diethylethylamine hydrochloride (a.k.a. N,N-diethylaminoethyl chloride hydrochloride, DEAEC-HCl), 129 g of isopropyl alcohol, and 21 g of distilled water. The round-bottomed flask was fitted with a stirring paddle and motor, a nitrogen inlet, a reflux condenser connected to a mineral oil bubbler, a subsurface thermocouple, and a rubber serum cap. The slurry is stirred and purged with nitrogen for about an hour.

While stirring under nitrogen, 10.98 g of 25% aqueous sodium hydroxide solution (25% NaOH) are added to the slurry over 1 minute using a plastic syringe. After the addition is complete, the mixture is stirred for 15 minutes, and then using a heating mantle, a J-KEM temperature controller, and the thermocouple, heat is applied to the slurry. The slurry is held at 40° C. for two hours, then cooled to room temperature and neutralized by adding 5.00 g of glacial acetic acid followed by stirring for about 15 minutes.

The resulting polymer is recovered by vacuum filtration through a Buchner funnel and washed a Waring blender: five times with a mixture of 300 ml of acetone and 70 ml of distilled water and twice with 400 ml of pure acetone. The polymer may be glyoxal treated in the last desiccation step (second pure acetone wash) by adding 1.0 g of 40% glyoxal and 0.2 g of glacial acetic acid. The polymer is dried overnight in vacuo at 50° C.

The final product is characterized for volatiles (7.1%) and ash (2.1%, calculated as sodium acetate) using the method described in ASTM D-2364. The Kjeldahl nitrogen content (corrected for ash and volatiles) is found to be 0.85%.

Examples 2-7

Using substantially the same procedures as described in Example 1, while making appropriate substitutions in reagents and amounts as needed, Examples 2-7 materials, shown in Tables 1 and 2, may be prepared.

TABLE 1

Synthesis of tertiary amino-modified hydroxyethyl cellulose

| | CELLOSIZE HEC | | | |
|---|---|---|---|---|
| Example | Type | Mw | DEAEC-HCl | 25% NaOH |
| 1 | A | 450,000 | 5.44 g | 10.98 g |
| 2 | A | 450,000 | 10.86 g | 16.05 g |
| 3 | B | $1.0 \times 10^6$ | 5.42 g | 10.97 g |
| 4 | B | $1.0 \times 10^6$ | 10.87 g | 16.01 g |
| 5 | C | $1.6 \times 10^6$ | 5.49 g | 11.00 g |
| 6 | C | $1.6 \times 10^6$ | 10.87 g | 16.01 g |
| 7 | B | $1.0 \times 10^6$ | — | — |

TABLE 2

Characterization of tertiary amino-modified hydroxyethyl cellulose

| Example | Kjeldahl nitrogen | DS |
|---|---|---|
| 1 | 0.85% | 0.17 |
| 2 | 1.55% | 0.33 |
| 3 | 0.71% | 0.14 |
| 4 | 1.44% | 0.30 |
| 5 | 0.91% | 0.18 |
| 6 | 1.59% | 0.34 |
| 7 | 1.53% | 0.32 |

Example 8

Testing in Laundry

Four types of fabric (terry cotton, cotton interlock, cotton percale and polyester/cotton blend) are laundered with Purex Free Clear or Tide liquid detergent with and without tertiary amine substituted cellulose derivative of the invention (introduced into the wash liquor. as part of a fragrance enhancement package (with Purex Crystals). The polymer is added at 1% of the Purex Crystals dosage (or 0.0047 gram/Liter). The fabrics are laundered under typical washing conditions (cold water wash, low/moderate water hardness, 12 minute wash and 3 minute rinse) using a standard detergent dosage (0.88 gram/Liter) and an orange (high iron content) 25% solids clay slurry as the added soil load (2.5 grams/Liter of the 25% slurry. The garments are laundered for three consecutive cycles, and the whiteness index is measured at 460 nm utilizing a Hunter Colorimeter to record fabric whiteness. The data is depicted in Tables 3-5 for Purex Free Clear liquid detergent and Table 6 for Tide liquid. The whiteness index for the neat unwashed fabrics is represented in the Tables (positive control), and internal controls are also run for the neat detergent (Purex/Tide) and the neat detergent with Purex Crystals. The non-derivatized HECs (comparative materials) are also included to show the impact of derivatized hydroxyethylcellulose, according to the invention on fabric whiteness maintenance.

TABLE 3

| Detergent | Purex Crystals | Cellulosic Polymer | Fabric (Whitening Index) Terry Cotton | Cotton Percale | Cotton Interlock | Polyester/Cotton |
|---|---|---|---|---|---|---|
| None | None | None* | 154.9 | 138.0 | 108.1 | 121.1 |
| Purex | None | None* | 134.8 | 117.7 | 110.0 | 74.4 |
| Purex | Yes | None* | 139.5 | 120.7 | 110.7 | 80.0 |
| Purex | Yes | Ex. 3 | 90.2 | 81.7 | 46.2 | 62.6 |
| Purex | Yes | Ex. 4 | 98.5 | 88.5 | 41.5 | 64.7 |
| Purex | Yes | Ex. 7 | 91.5 | 81.4 | 31.9 | 65.1 |
| Purex | Yes | HEC type B (not derivatized)* | 130.6 | 103.7 | 103.5 | 82.3 |

*Non-inventive/comparative example.

TABLE 4

| Detergent | Purex Crystals | Cellulosic Polymer | Fabric (Whitening Index) Terry Cotton | Cotton Percale | Cotton Interlock | Polyester/Cotton |
|---|---|---|---|---|---|---|
| None | None | None* | 153.5 | 126.2 | 107.3 | 119.2 |
| Purex | Yes | Ex. 1 | 79.1 | 67.1 | 17.1 | 63.9 |
| Purex | Yes | Ex. 2 | 86.3 | 70.0 | 21.1 | 66.3 |
| Purex | Yes | Ex. 5 | 124.1 | 110.6 | 91.2 | 66.2 |
| Purex | Yes | Ex. 6 | 131.6 | 117.7 | 93.4 | 68.6 |
| Purex | Yes | Ex. 7 | 83.5 | 70.1 | 20.0 | 63.6 |
| Purex | Yes | HEC type C (not derivatized)* | 125.2 | 98.8 | 95.6 | 69.4 |

*Non-inventive/comparative example.

TABLE 5

| Detergent | Purex Crystals | Cellulosic Polymer | Fabric (Whitening Index) Terry Cotton | Cotton Percale | Cotton Interlock | Polyester/Cotton |
|---|---|---|---|---|---|---|
| None | None | None* | 153.4 | 126.5 | 109.0 | 122.4 |
| Purex | Yes | None* | 145.5 | 120.6 | 103.8 | 86.0 |
| Purex | Yes | Ex. 7 | 107.8 | 98.3 | 64.2 | 91.9 |
| Purex | Yes | Ex. 6 | 138.1 | 117.1 | 103.4 | 85.5 |
| Purex | Yes | HEX cellulose (HEC) medium-low Mw (underivatized)* | 144.8 | 118.0 | 110.0 | 82.4 |

*Non-inventive/comparative example.

TABLE 6

| Detergent | Purex Crystals | Cellulosic Polymer | Fabric (Whitening Index) Terry Cotton | Cotton Percale | Cotton Interlock | Polyester/Cotton |
|---|---|---|---|---|---|---|
| None | None | None* | 153.7 | 135.1 | 115.5 | 117.2 |
| Tide | None | None* | 137.2 | 136.5 | 128.3 | 75.7 |
| Tide | Yes | None* | 142.0 | 138.1 | 117.8 | 68.8 |
| Tide | Yes | Ex. 7 | 110.3 | 79.9 | 82.3 | 59.0 |
| Tide | Yes | Ex. 4 | 106.6 | 80.0 | 78.0 | 71.8 |
| Tide | Yes | Ex. 2 | 102.5 | 60.7 | 70.3 | 56.8 |
| Tide | Yes | Ex. 6 | 130.9 | 133.5 | 120.2 | 81.7 |

*Non-inventive/comparative example.

From the data in Tables 3-6, it becomes apparent that tertiary amine substituted cellulose derivatives of the invention, particular those of higher molecular weight backbone DEAE derivatives (e.g., Examples 5 and 6)) deliver improved anti-graying properties versus their lower molecular weight counterparts with both Purex Free Clear and Tide liquid detergents.

Example 9

Exemplary hand dishwashing compositions contain the components recited in TABLES 1A-1B expressed in a range on a weight/weight basis (wt. %).

TABLE 1A

| | Formulation A | Formation B | Formation C |
|---|---|---|---|
| Linear Alkyl Benzene Sulfonate, Na salt | 12-15 | 3-5 | 8-12 |
| Sodium Alcohol Ethoxylate Sulfate | 5-7 | 12-15 | 3-5 |
| $C_{12/14}$ Dimethyl Amine Oxide | — | 4-8 | — |
| Lauryl/Myristyl Diethanolamide | 2-4 | — | — |
| Alcohol Alkoxylate (ECOSURF EH-6) | — | 2-4 | 1-3 |
| tertiary amine substituted cellulose derivative | 0.1-0.5 | 0.1-0.5 | 0.1-0.3 |
| Ethanol | 3-5 | 3-5 | 2-5 |
| Sodium Xylene Sulfonate (40%) | 2-4 | 2-4 | 2-4 |
| Optional Co-Solvents (PPG 400, 2000 Propylene Glycol, Glycerine) | 0-5 | 0-5 | 0-5 |
| Optional Polyacrylate Dispersants | 0-2 | 0-2 | 0-2 |
| Optional Rheology Modifiers | 0-1 | 0-1 | 0-1 |
| Optional Enzymes (Protease/Amylase) | 0-2 | 0-2 | 0-2 |
| Optional Adjuvants (Fragrance, Color) | 0-2 | 0-2 | 0-2 |
| Deionized water | Balance | Balance | Balance |

TABLE 1B

| | Formulation D | Formation E | Formation F |
|---|---|---|---|
| Linear Alkyl Benzene Sulfonate, Na salt | 12-15 | 3-5 | 8-12 |
| Sodium Alcohol Ethoxylate Sulfate | 5-7 | 12-15 | 3-5 |
| $C_{12/14}$ Dimethyl Amine Oxide | — | 4-8 | — |
| Lauryl/Myristyl Diethanolamide | 2-4 | — | — |
| Alcohol Alkoxylate (ECOSURF EH-6) | — | 2-4 | 1-3 |
| tertiary amine substituted cellulose derivative | 0.1-0.5 | 0.1-0.5 | 0.1-0.3 |
| Ethanol | 3-5 | 3-5 | 2-5 |
| Sodium Xylene Sulfonate (40%) | 2-4 | 2-4 | 2-4 |
| Optional Co-Solvents (PPG 400, 2000 Propylene Glycol, Glycerine) | 0-5 | 0-5 | 0-5 |
| Optional Polyacrylate Dispersants | 0-2 | 0-2 | 0-2 |
| Optional Rheology Modifiers | 0-1 | 0-1 | 0-1 |
| Optional Enzymes (Protease/Amylase) | 0-2 | 0-2 | 0-2 |
| Optional Adjuvants (Fragrance, Color) | 0-2 | 0-2 | 0-2 |
| Deionized water | Balance | Balance | Balance |

The hand dishwashing compositions are prepared with conventional mixing techniques that are well known to those skilled in the art.

Example 10

Exemplary powder laundry compositions contain the components recited in TABLES 2A-2B expressed in a range on a weight/weight basis (wt. %).

TABLE 2A

| | Formulation G | Formation H |
|---|---|---|
| Linear Alkyl Benzene Sulfonate, Na salt | 6-14 | 8-16 |
| Sodium Alcohol Ethoxylate Sulfate | 2-6 | 2-8 |
| Soda Ash | 30-80 | 20-30 |
| Zeolite 4A (VALFOR 100) | 5-20 | 10-40 |
| Sodium Citrate Dihydrate | 0-30 | 10-40 |
| Sodium Silicate (corrosion inhibitor) | 2-6 | 2-6 |
| tertiary amine substituted cellulose derivative | 0.1-0.5 | 0.1-0.5 |
| Polycarboxylates (ACUSOL 425N, A445N, A845) | 2-8 | 2-4 |
| Optical Brighteners (Stilbene derivatives) | 0.05-0.5 | 0.05-0.5 |
| Optional Alcohol Ethoxylate/Alkoxylate | 0-2 | 0-2 |
| Optional Fatty Acid Soap, Na or K salt | 0-4 | 0-4 |
| Optional Aminopolycarboxylates (TRILON M (MGDA); DISSOLVINE GL (GLDA); OR VERSENE HEIDA) | 0-5 | 0-30 |
| Optional Sodium Percarbonate (peroxygen bleach) | 0-5 | 0-20 |
| Optional TAED/SNOBS (bleach activator) | 0-2 | 0-5 |
| Optional Co-Solvents (PPG 400, 2000 Propylene Glycol, Glycerine) | 0-1 | 0-1 |
| Optional Enzymes (Protease/Amylase) | 0-1 | 0-2 |
| Optional Adjuvants (Fragrance, Color) | 0-2 | 0-2 |
| Inorganic Fillers ($Na_2SO_4$, NaCl) | Balance | Balance |

TABLE 2B

| | Formulation I | Formation J |
|---|---|---|
| Linear Alkyl Benzene Sulfonate, Na salt | 6-14 | 8-16 |
| Sodium Alcohol Ethoxylate Sulfate | 2-6 | 2-8 |
| Soda Ash | 30-80 | 20-30 |
| Zeolite 4A (VALFOR 100) | 5-20 | 10-40 |
| Sodium Citrate Dihydrate | 0-30 | 10-40 |
| Sodium Silicate (corrosion inhibitor) | 2-6 | 2-6 |
| tertiary amine substituted cellulose derivative | 0.1-0.5 | 0.1-0.5 |
| Polycarboxylates (ACUSOL 425N, A445N, A845) | 2-8 | 2-4 |
| Optical Brighteners (Stilbene derivatives) | 0.05-0.5 | 0.05-0.5 |
| Optional Alcohol Ethoxylate/Alkoxylate | 0-2 | 0-2 |
| Optional Fatty Acid Soap, Na or K salt | 0-4 | 0-4 |
| Optional Aminopolycarboxylates (TRILON M (MGDA); DISSOLVINE GL (GLDA); OR VERSENE HEIDA) | 0-5 | 0-30 |
| Optional Sodium Percarbonate (peroxygen bleach) | 0-5 | 0-20 |
| Optional TAED/SNOBS (bleach activator) | 0-2 | 0-5 |
| Optional Co-Solvents (PPG 400, 2000 Propylene Glycol, Glycerine) | 0-1 | 0-1 |
| Optional Enzymes (Protease/Amylase) | 0-1 | 0-2 |
| Optional Adjuvants (Fragrance, Color) | 0-2 | 0-2 |
| Inorganic Fillers ($Na_2SO_4$, NaCl) | Balance | Balance |

The powder laundry compositions are prepared with conventional mixing techniques that are well known to those skilled in the art.

Example 11

Exemplary liquid laundry compositions contain the components recited in TABLES 3A-3B expressed in a range on a weight/weight basis (wt. %).

TABLE 3A

| | Formulation K | Formation L |
|---|---|---|
| Linear Alkyl Benzene Sulfonate, Na salt | 4-18 | 4-8 |
| Sodium Alcohol Ethoxylate Sulfate | 3-5 | 2-4 |
| Alcohol Ethoxylate/Alkoxylate | 8-12 | 2-4 |
| Sodium Citrate Dihydrate | 2-10 | 0-5 |
| tertiary amine substituted cellulose derivative | 0.1-0.5 | 0.1-0.5 |
| Ethanol | 1-5 | 1-3 |
| Propylene Glycol | 4-8 | 3-5 |
| Sodium Xylene Sulfonate (40%) | 2-4 | 0-4 |
| Optical Brighteners (Stilbene derivatives) | 0.05-0.5 | 0.05-0.5 |
| Optional Sodium Silicate (corrosion inhibitor) | 0-1 | 0-1 |
| Optional Soda Ash | 0-2 | 0-2 |
| Optional Fatty Acid Soap, Na or K salt | 0-4 | 0-4 |
| Optional Aminopolycarboxylates (TRILON M (MGDA); DISSOLVINE GL (GLDA); OR VERSENE HEIDA) | 0-10 | 0-5 |
| Optional Co-Solvents (PPG 400, 2000 Propylene Glycol, Glycerine) | 0-5 | 0-3 |
| Optional Enzymes (Protease/Amylase) | 0-2 | 0-1 |
| Optional Polycarboxylates (ACUSOL 425N, A445N, A845) | 0-1 | 0-1 |
| Optional Adjuvants (Fragrance, Color) | 0-2 | 0-2 |
| Deionized Water | Balance | Balance |

TABLE 3B

| | Formulation M | Formation N |
|---|---|---|
| Linear Alkyl Benzene Sulfonate, Na salt | 4-18 | 4-8 |
| Sodium Alcohol Ethoxylate Sulfate | 3-5 | 2-4 |
| Alcohol Ethoxylate/Alkoxylate | 8-12 | 2-4 |
| Sodium Citrate Dihydrate | 2-10 | 0-5 |
| tertiary amine substituted cellulose derivative | 0.1-0.5 | 0.1-0.5 |
| Ethanol | 1-5 | 1-3 |
| Propylene Glycol | 4-8 | 3-5 |
| Sodium Xylene Sulfonate (40%) | 2-4 | 0-4 |
| Optical Brighteners (Stilbene derivatives) | 0.05-0.5 | 0.05-0.5 |
| Optional Sodium Silicate (corrosion inhibitor) | 0-1 | 0-1 |
| Optional Soda Ash | 0-2 | 0-2 |
| Optional Fatty Acid Soap, Na or K salt | 0-4 | 0-4 |
| Optional Aminopolycarboxylates (TRILON M (MGDA); DISSOLVINE GL (GLDA); OR VERSENE HEIDA) | 0-10 | 0-5 |
| Optional Co-Solvents (PPG 400, 2000 Propylene Glycol, Glycerine) | 0-5 | 0-3 |
| Optional Enzymes (Protease/Amylase) | 0-2 | 0-1 |
| Optional Polycarboxylates (ACUSOL 425N, A445N, A845) | 0-1 | 0-1 |
| Optional Adjuvants (Fragrance, Color) | 0-2 | 0-2 |
| Deionized Water | Balance | Balance |

The liquid laundry compositions are prepared with conventional mixing techniques that are well known to those skilled in the art.

Embodiments of the present invention may contain any combination of the optional components, or be represented by more generic terms, such as builders, chelants, surfactants, co-solvents, adjuvants, and the like in the appended claims.

The invention claimed is:

1. A laundry or dishwashing composition, comprising:

a tertiary amine substituted cellulose derivative having Formula I:

(I)

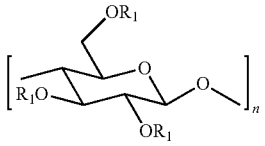

wherein n is an integer sufficient to produce a polymer with a weight-average molecular weight (Mw) in the range of about 50,000 to 2,000,000;

$R_1$ is, independently at each occurrence, H, —$CH_3$, or —$CH_2CH_2O$—$R_2$; and $R_2$ is, independently at each occurrence, H, $CH_3$, or $R_3N(R_4)_2$ or it salt wherein:

$R_3$ is $C_{1-6}$ alkylene;

$R_4$ is, independently at each occurrence, $C_{1-6}$ alkyl, or both $R_4$ groups may form, along with the nitrogen to which they are attached, a saturated or unsaturated 5 or 6 member heterocyclic ring, provided that at least one $R_1$ in the polymer contains an $R_3N(R_4)_2$ group; and at least one surfactant; and a builder, wherein the $R_3N(R_4)_2$ group is not a permanently charged quaternary amine, and wherein the tertiary amine substituted cellulose derivative of formula I has a tertiary amine degree of substitution, $DS_{amine}$, of the $R_3N(R_4)_2$ groups per molecule of 0.1 to 0.4.

2. The laundry or dishwashing composition of claim 1, wherein $R_3$ at each occurrence is ethylene.

3. The laundry or dishwashing composition of claim 1, wherein the tertiary amine substituted cellulose derivative is at least one of N,N-diethylaminoethyl hydroxyethylcellulose, N,N-dimethylaminoethyl hydroxyethylcellulose, N,N-diisopropyl aminoethyl hydroxyethylcellulose, N,N-dimethylaminopropyl hydroxyethylcellulose, N-ethyl piperidine hydroxyethylcellulose, N-ethyl morpholine hydroxyethylcellulose, or N-ethyl pyrrolidine hydroxyethylcellulose.

4. The laundry or dishwashing composition of claim 1, wherein the surfactant is linear alkyl benzene sulfonate, sodium alcohol ethoxylate sulfate, a mixture of linear alkyl benzene sulfonate and sodium alcohol ethoxylate sulfate, a nonionic alcohol ethoxylate, or mixtures thereof.

5. The laundry or dishwashing composition of claim 1, further comprising one or more of an inorganic builder/chelant, soda ash, a bleach, and/or a bleach activator.

6. The laundry or dishwashing composition of claim 1 further comprising one or more of a polyethylene glycol, starch, or clay.

7. A laundry or dishwashing composition, comprising:

a builder;

at least one surfactant; and a tertiary amine substituted cellulose derivative having Formula I:

(I)

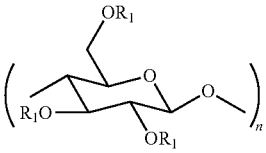

wherein n is an integer sufficient to produce a polymer with a weight-average molecular weight (Mw) in the range of about 50,000 to 2,000,000;

wherein $R_1$ is, independently at each occurrence, H, —$CH_3$, or —$CH_2CH_2O$—$R_2$; and wherein $R_2$ is, independently at each occurrence, H, $CH_3$, or $R_3N(R_4)_2$ or it salt, wherein $R_3$ is $C_{1-6}$ alkylene; wherein $R_4$ is, independently at each occurrence, $C_{1-6}$ alkyl, or both $R_4$ groups may form, along with the nitrogen to which they are attached, a saturated or unsaturated 5 or 6 member heterocyclic ring;

wherein the tertiary amine substituted cellulose derivative of formula I is a tertiary amine substituted hydroxyethylcellulose having an overall degree of substitution, $DS_{overall}$, of 1.17 to 1.18; and, wherein the tertiary amine substituted cellulose derivative of formula I has a tertiary amine degree of substitution, $DS_{amine}$, of non-permanently charged tertiary amine $R_3N(R_4)_2$ groups per molecule of 0.1 to 0.4.

8. The laundry or dishwashing composition of claim 7, wherein $R_3$ at each occurrence is ethylene.

9. The laundry or dishwashing composition of claim 7, wherein the tertiary amine substituted cellulose derivative is at least one of N,N-diethylaminoethyl hydroxyethylcellulose, N,N-dimethylaminoethyl hydroxyethylcellulose, N,N-diisopropylaminoethyl hydroxyethylcellulose, N,N-dimethylaminopropyl hydroxyethylcellulose, N-ethyl piperidine hydroxyethylcellulose, N-ethyl morpholine hydroxyethylcellulose and N-ethyl pyrrolidine hydroxyethyl cellulose.

10. The laundry or dishwashing composition of claim 7, wherein the surfactant is selected from the group consisting of a linear alkyl benzene sulfonate, a sodium alcohol ethoxylate sulfate, a nonionic alcohol ethoxylate, and mixtures thereof.

11. The laundry or dishwashing composition of claim 7, further comprising at least one of an inorganic builder/chelant, a soda ash, a bleach and a bleach activator.

12. The laundry or dishwashing composition of claim 7, further comprising at least one of a polyethylene glycol, a starch and a clay.

* * * * *